United States Patent [19]

Tamaddon

[11] 4,070,432

[45] Jan. 24, 1978

[54] PRODUCTION OF LOW SHRINK POLYESTER FIBER

[75] Inventor: Cyrus Tamaddon, Chester, Va.

[73] Assignee: Allied Chemical Corporation, Morris Township, N.J.

[21] Appl. No.: 702,792

[22] Filed: July 6, 1976

Related U.S. Application Data

[63] Continuation of Ser. No. 549,642, Feb. 13, 1975, abandoned.

[51] Int. Cl.[2] ..... D01D 5/16

[52] U.S. Cl. ..... 264/210 F; 264/342 RE

[58] Field of Search ..... 264/210 F, 342 RE; 425/72 S

[56] References Cited

U.S. PATENT DOCUMENTS

| | | | |
|---|---|---|---|
| 3,080,134 | 3/1963 | England et al. | 264/210 F |
| 3,080,135 | 3/1963 | Steijn | 264/210 F |
| 3,216,187 | 11/1965 | Chaufrg et al. | 264/210 F |
| 3,361,859 | 1/1968 | Cenzato | 264/210 F |
| 3,433,008 | 3/1969 | Gage | 264/210 F |
| 3,511,677 | 5/1970 | Strohmaier et al. | 264/210 F |
| 3,715,421 | 2/1973 | Martin | 264/210 F |
| 3,936,253 | 2/1976 | Fisher et al. | 264/210 F |
| 3,988,086 | 10/1976 | Marshall et al. | 264/210 F |

*Primary Examiner*—Jay H. Woo
*Attorney, Agent, or Firm*—Fred L. Kelly

[57] ABSTRACT

A low shrinkage polyester fiber is produced by melt-spinning a polyester polymer under conditions of substantially simultaneous spinning, drawing, and heat treating, using carefully controlled conditions whereby the fiber has uniform properties of breaking strength in grams per denier of at least 7.0, elongation at break in percent of 18 to 30, and a residual thermal shrinkage measured in an oven at 350° F. for one minute of lower than 3 percent. The low shrinkage polyester fibers are particularly useful in the preparation of reinforced elastomeric structures.

1 Claim, No Drawings

PRODUCTION OF LOW SHRINK POLYESTER FIBER

CROSS-REFERENCES TO RELATED APPLICATIONS

This is a continuation, of application Ser. No. 549,642, filed Feb. 13, 1975 now abandoned.

This application is related to my copending application Ser. No. 491,913, filed July 25, 1974 now abandoned.

BACKGROUND OF THE INVENTION

This invention relates to an improved process for the production of low shrinkage polyester fibers which are particularly useful in the preparation of reinforced elastomeric structures. More particularly, it relates to a continuous process for the production of low shrinkage polyester fibers by melt-spinning the polymer followed immediately by drawing and heat treating the spun fibers.

The production of polyester filaments useful for textile and industrial purposes is known. In many of the prior art methods, the spinning and drawing of the filaments are separately carried out. However, several processes have been developed which involve conditions of continuously spinning and drawing filaments.

U.S. Pat. No. 3,413,797 to Roy Chapman discloses that drawn polyester yarns having reduced shrinkage can be produced by heat treating the drawn yarns by passing them through a fluidized bed of solid particles maintained at a temperature of 240°–264° C.

More recently, it has been suggested in U.S. application Ser. No. 278,922, filed Aug. 9, 1972, now abandoned that low shrinkage polyester yarns can be produced by melt-spinning of a polyester polymer by substantially simultaneous spinning, lubricating, drawing and heat treating the fibers under controlled conditions. However, in commercial operation of this process at high throughput rates of 50 pounds per hour or greater through the spinneret, serious problems have been encountered in that uniform low shrinkage yarn could not be produced. In addition, problems have been encountered due to "flicking" of filaments from the main yarn bundle above the lube roll, which flicking results in production of yarn of relatively poor quality. Accordingly, research has been continued to solve these deficiencies.

The term "RMS," which is short for root-mean-square, is an arbitrary measurement of surface texture and is described in detail in the publication, Surface Texture (ASA B 46.1 - 1962), the American Society of Mechanical Engineers, United Engineering Center, 345 East 47th Street, N.Y. 17, New York, page 16 (1962). Such measurement is utilized throughout this invention disclosure unless otherwise stated.

The term "flicking" is conventionally applied and is used herein to mean a momentary slackness of a filament in the undrawn yarn above the lube roll. The slack filament bows out of phase from the main bundle, thus "flicking." It is known that excessive "flicking" normally causes production of yarn of relatively low quality having an excessive number of defects such as missing filaments, filament breaks and loops.

SUMMARY OF THE INVENTION

The present invention relates to an improved process for preparing low shrinkage polyester multifilamentary yarns having uniform quality. The process may be summarized as follows:

In the process for the production of a synthetic multifilamentary yarn from a high-molecular weight thermoplastic polymer, selected from the group consisting of linear polyester polymers, by melting-spinning, including the steps of supplying a melt of said polymer at a temperature below the spinning temperature, and heating the melt to spinning temperature prior to filament formation, the improvement which comprises:

a. extruding the molten synthetic polymer at a rate of at least 50 pounds per hour downwardly through a spinneret having a plurality of extrusion orifices;

b. advancing the extruded filaments downwardly through a substantially stationary column of air having a temperature of 100° to 330° C. immediately below the spinneret, the average distance between adjacent filaments immediately below the spinneret being at least 0.24 inch, preferably 0.28 to 0.4 inch;

c. subsequently advancing the filaments downwardly through a quenching zone wherein they are in contact with cooling air introduced into the path of the filaments, said air contacting the filaments at a volumetric rate of 100 to 800 cubic feet of air per pound of filaments entering the quenching zone;

d. lubricating the cooled filaments at a temperature of at least 40° C., preferably 40° to 60° C. by surface contact with a roll surface at a contact angle of about 7° to 15°, preferably about 10° to 12°, said roll having a surface of 135 to 205 RMS, preferably 140 to 160 RMS;

e. passing the lubricated filaments over a forwarding roll system maintained at a temperature of less than 50° C.;

f. heating the filaments substantially immediately above their second order transition temperature;

g. drawing the filaments substantially instantly by passing said filaments over a draw roll system maintained at a temperature of between about 130° and about 190° C.;

h. heat treating the drawn filaments by passing said filaments for 60–200 milliseconds over a heated roll system maintained at a temperature in the range of about 235° to about 255° C., said filaments being maintained at a tension in grams of between about 0.04 and about 0.10 grams per denier; and i. winding up said filaments.

It will be understood that the number of drawing rolls can be modified if desired. For example, the yarn may be drawn and heat treated on a seven roll panel or on a four roll panel. However, regardless of panel set up, the draw panel process steps preferably involve pretensioning to provide yarn stability on the rolls, feed rolls to provide constant yarn supply to the draw zone, a draw point localizer to provide draw-down point in the draw zone, draw rolls to maintain constant draw ratio, and heat treatment rolls to provide for control of yarn physical properties. Preferably, a yarn compaction jet is used after the heat treatment rolls to provide yarn entanglement.

Surprisingly, in operation of the process of the present invention at high throughput rates of 50 pounds per hour or greater through the spinneret, uniform low shrinkage yarn was produced and "flicking" of filaments from the main yarn bundle above the lube roll was significantly reduced with a corresponding marked decrease in product defects.

DESCRIPTION OF THE PREFERRED EMBODIMENT

It has now been found that low shrinkage multifilament polyester yarn, e.g., polyethylene terephthalate multifilament yarn, including such yarn of high denier per filament, e.g., 20 to 50 denier per filament (undrawn) can be melt spun continuously at high production rate such as 50 to 90 pounds per hour, and this yarn can be continuously drawn and heat treated without an intermediate step of winding up, at draw ratios of at least 5:1. These results are achieved in accordance with this invention, by employing controlled conditions whereby the shrinkage of the yarn is reduced and the "flicking" of filaments from the yarn bundle above the lube roll is not above 10 per minute.

In accordance with the preferred process, a relatively large number of heavy filaments are extruded downwardly into a substantially stationary column of air having a temperature of 100° to 330° C. and a height of from 0.5 to 2 feet, more preferably 1 to 1.5 feet, immediately below the spinneret, the distance between adjacent filaments immediately below the spinneret being preferably 0.28 to 0.4 inch, and subsequently advancing the filaments through a quenching zone wherein they are contacted with cooling air entering the zone at a volumetric flow rate of preferably 200 to 700 cubic feet of air (measured at standard temperature and pressure) per pound of entering filaments, the air being at inlet temperature not above 35° C. Preferably, the cooled filaments are lubricated at a temperature of 40° to 60° C., by surface contact with a roll surface at a contact angle of about 10° to 12°, said roll having a diameter of about 4 to 6 inches and a surface of 140 to 160 RMS.

A conventional spinning finish composition is used to lubricate the filaments. A typical finish comprises a lubricant and may contain a diluent, an antistatic compound, an emulsifier and a wetting agent. For example, excellent results have been obtained when the filaments are coated with from about 0.3 to about 0.6 weight percent based on the weight of the yarn of a liquid composition consisting essentially of about 10 to about 20 weight percent of said composition of each hexadecyl stearate and refined coconut oil, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkylarylsulfonate, about 1.0 to about 3.0 weight percent of said composition of dinonyl-sodium-sulfosuccinate, about 1.0 to about 3.0 weight percent of said composition of an antioxidant selected from the group consisting of 4,4'-butylidene-bis-(6-tert-butyl-m-cresol), thio-bis-(di-sec-amylphenol), trinonyl phenol phosphite, and 2,2-methylene-bis-(4-methyl-6-tert-nonylphenol), about 35 to 50 weight percent of said composition of white mineral oil having a boiling point of between 510° F. and 620° F.

Preferably, the viscosity of the finish composition is maintained at about 10 to 20 centipoises, measured at the temperature of application. The lube roll may be rotated either with or against the direction of yarn movement; however, at the lower operating tempertures less flicking results when the lube roll is rotated against the direction of yarn movement. Preferably, rotation of the lube roll is at a relatively low rate, e.g., 1 to 5 revolutions per minute for a lube roll having a diameter of 4 to 6 inches.

The preferred polyesters are the linear terephthalate polyesters, i.e., polyesters of a glycol containing from 2 to 20 carbon atoms and a dicarboxylic acid component comprising at least about 75% terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-di-benzofuran-dicarboxylic acid. The glycols may contain more than two carbon atoms in the chain, e.g., diethylene glycol, butylene glycol, decamethylene glycol, and bis-1,4-(hydroxymethyl) cyclohexane. Examples of linear terephthalate polyesters which may be employed include poly(ethylene terephthalate), poly(butylene terephthalate), poly(ethylene terephthalate/5-chloroisophthalate) (85/15), poly(ethylene terephthalate/5-[sodium sulfo]isophthalate) (97/3), poly(cyclohexane-1,4-dimethylene terephthalate), and poly(cyclohexane-1,4-dimethylene terephthalate/hexahydroterephthalate) (75/25).

It is important that the above-described process of the present invention permits a significant increase in production capacity of a polymer spinning operation. In some cases, it is practical to convert a single-end fiber plant to double-end plant with only simple changes in the original equipment, the yarn production being increased for example by a factor of 2. Also, the present invention substantially overcomes problems of poor yarn quality such as the formation of loose filament loops and broken filaments.

In order to demonstrate the invention, the following examples are given. They are provided for illustrative purposes only and are not to be construed as limiting the scope of the invention, which is defined by the appended claims. In these examples, parts and percentages are by weight unless otherwise indicated. The intrinsic viscosity of the polyester is given as a measure for the mean molecular weight, which is determined by standard procedures wherein the concentration of the measuring solution amounts to 0.5 g/100 ml., the solvent is a 60 percent phenol 40 percent tetrachloroethane mixture, and the measuring temperature is 25° C.

EXAMPLE 1

A lubricating finish composition for use in the process of the present invention is prepared by mixing the following finish components:

| Finish Components | Parts | Function |
|---|---|---|
| Refined coconut glyceride | 14.7 | Lubricant |
| Hexadecyl stearate | 14.7 | Lubricant |
| Ethoxylated lauryl alcohol (4 EO) | 12.7 | Emulsifier |
| Sodium petroleum sulfonate 60–62% active in mineral oil | 9.8 | Antistat emulsifier |
| Ethoxylated tallow amine (20 EO) | 4.9 | Antistat emulsifier |
| Sodium salt of sulfonated succinic ester | 2.0 | Wetting agent |
| "Naugawhite"(2,2-methylene-bis-(4-methyl-6-tert-nonylphenol) | 2.0 | Antioxidant |
| Mineral oil viscosity 40 SSU | 39.2 | Continuous phase |

Similar process finishes may be prepared in which the 2,2-methylene-bis-(4-methyl-6-tert-nonyl-phenol) is replaced with an equal weight of one of the following antioxidants: 4,4'-butylidene-bis-(6-tert-butyl-m-cresol), thio-bis-(di-sec-amylphenol), and trinonlyl phenol phosphite.

EXAMPLE 2

A melt of polyethylene terephthalate having an intrinsic viscosity of about 0.92 was supplied at a rate of 60 pounds per hour, at a temperature of about 291° C., to a spinning pump which fed a spinning block containing a conventional spinning pot comprising a spinning filter and a spinneret, the spinning filter being disposed between the spinning pump and the spinneret. The spinning filter consisted of a conventional sieve filter combination of 24 metal screen layers. The pressure drop through said spinning filter averaged 200 to 400 atmospheres. The spinning pot was enclosed in a controlled high temperature atmosphere so that loss of heat from the polymer was minimized. The melt enthalpy increase through the pump and sieve filter was sufficient to heat the melt at a point immediately above the spinneret to about 305°–310° C., and the pressure at this point was about 50 atmospheres. The flow of polymer through the spinneret was maintained at a constant rate of 60 pounds per hour by the spinning pump.

The spinning pot spinneret was divided into two parts by means of an undrilled "stripe" wide enough to form a visible split between the multiple ends below the spinneret. The spinneret plate had 384 holes (192 holes on each side of the undrilled stripe), each of 0.018 inch diameter, spaced so that the distance between the filaments formed was 0.28 to 0.40 inch immediately below the spinneret.

From said spinneret there was extruded two ends of multifilament, continuous filament yarn, and the two ends were passed downwardly into a substantially stationary column of air contained in a heated sleeve, about 15 inches in height, disposed surrounding and immediately beneath the spinneret. The air temperature in the heated sleeve was maintained at about 300° C. at the top of the sleeve, decreasing to about 115° C. at the bottom. The temperature of the metal in the heated sleeve was about 330° C. at the top and 220° C. at the bottom of the sleeve. The minimum distance between filaments at the bottom of the heated sleeve was about 0.24 inches. A heated sleeve baffle was provided at the bottom of the heated sleeve forming an inwardly extending flange to minimize flow of cooling air into the heated sleeve.

The two ends of multifilament, continuous filament yarn leaving the heated sleeve were passed directly into the top of a quenching chamber at least 60 inches in height where the temperature of the filaments was reduced to not over 55° C., preferably about 50° C., by contacting said filaments with a cross flow of quenching air at about 25° C. and 65% relative humidity, supplied at about 200 cubic feet of air per pound of filaments entering the quenching chamber.

Following quenching, the filaments were lubricated by surface contact with a roll surface of 150 RMS. The lubrication roll had a diameter of about 5 inches and was rotated in the direction of yarn movement at 2 revolutions per minute. The angle of contact of the yarn on the roll was about 10.5°. The lubrication was furnished by the finish composition described in Example 1, and a constant finish temperature of about 50° C. was maintained. The viscosity of the finish was about 13 centipoises at the temperature of application. About 0.3 to 0.4 weight percent of the finish composition was applied to the yarn based on the weight of the yarn, and the percent oil on the yarn averaged about 0.22%, based on the weight of the yarn.

Following lubrication, the ends passed through a guide separation to a pretension roll with its accompanying separator roll. The yarn was then passed over cold feed roll pair Godet rolls, then through a draw point localizer which was a conventional steam jet, then to a draw roll pair of Godet rolls operated at about 158° C. and traveling at a speed 5.0 to 6.6 times faster than the feed roll, then to heat treatment Godet rolls operated at about 246° C. Residence time of the yarn on the heat treatment rolls was about 144 milliseconds. The tension on the yarn between the relaxation rolls and the winder was maintained at 0.075 grams per denier. Finally, the heat-treated yarn was passed through an compacting apparatus, i.e., a conventional air operated interlacing jet, and then on to a conventional winder. Typical yarn prepared at a draw ratio of 6 had the following properties:

| | |
|---|---|
| Denier | 1,100 |
| Tenacity, g/d | 7.8 |
| Elongation, % | 24.6 |
| Shrinkage, % | 0.8 |

In this example, "flicking" of filaments from the main yarn bundle above the lube roll was observed at intervals over an extended period of operation. For testing purposes, flicking was arbitrarily defined as any movement of a filament greater than 0.25 inch from the main bundle. The point of measurement was arbitrarily selected at 3 inches above the lube roll. Any movement of filaments greater than 0.25 inch was counted for a period of 5 minutes. The average number of "flicks" was about 1.6 per minute. The standard deviation ($\sigma$) of the test was about 1 "flick" per minute.

EXAMPLE 3

A series of tests were carried out in accordance with the procedure of Example 2 except that the step involving heat treatment of the drawn yarn was modified to show the effect on the shrinkage properties of the yarn of changing the yarn treatment temperature, residence time, and winder tension. The treatment time was varied by changing the number of wraps of the yarn on the heat treatment rolls. The following table summarizes results of the tests:

| Heat Treatment Conditions | | | Yarn Properties | |
|---|---|---|---|---|
| Time, Milliseconds | Temperature, ° C | Tension, g/d | Thermal** Shrinkage, % | Tenacity, g/d |
| 36 | 232 | 0.075 | 8.9 | 9.0 |
| 60 | 240 | 0.075 | 3.0 | 8.8 |
| 84 | 240 | 0.075 | 2.2 | 8.6 |
| 144 | 246 | 0.075 | 0.8 | 7.8 |
| 192 | 246 | 0.075 | 0.5 | 7.8 |
| 192 | 249 | 0.045 | −0.2*** | 7.4 |
| 192* | 249 | 0.045 | −0.7*** | 7.0 |

*Compacting step was omitted for this sample.
**Thermal shrinkage measured in an oven at 350° F. with 0.05 grams per denier tension for one minute.
***These yarn samples not only did not shrink, they elongated slightly, i.e., they showed a negative shrinkage.

In these and other similar tests, it was determined that the drawn filaments are desirably heat treated by passing the filaments for 60–200 milliseconds over a heated roll system maintained at a temperature in the range of about 235° C. to 255° C., said filaments being maintained at a tension in grams between about 0.04 and about 0.10 grams per denier. Typical yarn produced under these conditions had uniform properties of breaking strength in grams per denier of at least 7.0, elongation at break in percent of 18 to 30, and a residual thermal shrinkage measured in an oven at 350° F. for one minute of lower than about 3 percent.

EXAMPLE 4

A series of tests were carried out to produce yarn using the process of Example 2 but modifying various steps of the process to determine the criticalness of the process elements required to produce high quality yarn. In this example, the procedure of Example 2 was followed except that the heated sleeve baffle at the bottom of the heated sleeve was opened so that there was no longer a substantially stationary column of air in the heated sleeve. The extent of "flicking" increased to greater than 60 "flicks" per minute, and high qualtiy yarn could not be produced. In other tests, it was demonstrated that optimum results are obtained when the heated sleeve baffle is used and the air temperature in the heated sleeve is maintained at about 300° C. at the top of the sleeve, decreasing to about 115° C. at the bottom of the sleeve.

EXAMPLE 5

A series of tests were carried out to produce yarn using the process of Example 2 but modifying various lubrication factors. Most important effect noted was the interaction effect resulting when the effects of finish temperature, lube roll RMS, and angle of contact on the lube roll were combined to reduce "flicking," preferably to no more than 4 "flicks" per minute. In operation of the process substantially in accordance with Example 2, it was found that the "flicking" of the filaments could be reduced to a minimum value by a combination of the following factors:

a. maintaining a constant finish temperature of 40°-60° C. on the lube roll;

b. using a lube roll having a RMS of 140–160; and c. keeping the angle of yarn contact on the lube roll at about 10°-12°.

For purposes of this invention, the term "angle of yarn contact on the lube roll" is defined as the total angular displacement from the tangential of the running yarn in contact with the surface of the lube roll, said running yarn being in a partial wrap about the lube roll.

EXAMPLE 6

This example demonstrates that the controlled conditions of cooling the filaments in the quenching zone are also critical with respect to the extent of "flicking" of the filament above the lube roll.

The procedure of Example 2 was followed except that the filaments advancing through the quenching zone were contacted with cooling air entering the zone at 100 cubic feet of air (measured at standard temperature and pressure) per pound of entering filaments. (In example 2, cooling air entered the zone at 200 cubic feet of air per pound of filaments). In this test a significant decrease in flicking was observed; however, quenching was considered inadequate because predrawing began to occur. When the filaments were contacted with cooling air at rates higher than 700 cubic feet of air per pound of filaments, the number of "flicks" per minute were increased to greater than 5. Accordingly, it is generally desirable for the cooling air to enter the zone at 200–700 cubic feet of air per pound of entering filaments.

CONCLUSIONS

Based on these examples and further test, it was concluded that the preferred process of the present invention produces an improved polyethylene terephthalate fiber which has uniform properties of: tenacity or breaking strength in grams per denier of from about 7 to about 9, elongation at break in percent of from about 18 to about 30, a tensile modulus in grams per denier of 60 to 74, a toughness index in grams centimeter per denier centimeter of about 0.9 to 1.0, and a residual thermal shrinkage measured in an oven at 350° F. for 1 minute of about −1 to 3 percent.

Certain terms referred to above or elsewhere in the specification are defined below. The term "breaking strength" is defined by ASTM Standards, Part 24, American Society for Testing and Materials, 1916 Race Street, Philadelphia, Pa., page 33 (1965) as the "the maximum resultant internal force that resists rupture in a tension test," or "breaking load or force, expressed in units of weight required to break or rupture a specimen in a tensile test made according to specified standard procedures."

The term "tensile modulus" (Young's Modulus) is expressed as the ratio of change in strain in the initial straight-line portion of the stress-strain curve extrapolated to 100% sample elongation.

The term "toughness index" taken from the same reference book is defined as "the actual work per unit volume or per unit mass of material which is required to rupture the material. It is proportional to the area under the load elongation curve from the origin to the breaking point." The toughness index is routinely measured in grams centimeter per denier centimeter.

The term "shrinkage" is defined as "percent decrease in length of a material when exposed to elevated temperatures for a specified period of time and under 0.05 g.p.d. tension."

I claim:

1. A melt-spinning process for production of a low shrinkage polyester yarn having uniform properties of breaking strength in grams per denier of at least 7.0, and a residual thermal shrinkage measured in an oven at 350° F. for 1 minute of 0.8 to −0.7 percent, which comprises: supplying a melt of high molecular weight, linear polyester polymer at a temperature below the spinning temperature and at a high pressure to a spinning unit comprising a spinning pump, a spinneret, and a spinning filter disposed between said pump and said spinneret; passing said melt by means of said spinning pump through said spinning filter prior to said melt passing through said spinneret whereby the temperature of the melt is increased to about 305° to 310° C.; extruding the melt at a rate of 50 to 90 pounds per hour downwardly through a spinneret having a plurality of extrusion orifices to form filaments; advancing the extruded filaments downwardly through a substantially stationary column of air having a temperature of 100° to 330° C. and a height of from 1 to 1.5 feet immediately below the spinneret, the average distance between adjacent filaments immediately below the spinneret being 0.28 to 0.4 inch; subsequently advancing the filaments downwardly through a quenching zone wherein they are in contact with a cross flow of cooling air introduced into the path of the filaments at a temperature not above 35° C., said air contacting the filaments at a volumetric rate of 100 to 800 cubic feet of air per pound of filaments entering the quenching zone, whereby the temperature of the filaments is reduced to not over 55° C.; lubricating the cooled filaments at a temperature of 40° to 60° C. by surface contact with a roll surface at a contact angle of about 10° to 12°, said roll having a surface of 140 to 160 RMS; passing the lubricated filaments over a forwardly roll system maintained at a temperature of less than 50° C.; heating the filaments substantially immediately above their second order transition temperature; drawing the filaments substantially instantly by passing said filaments over a draw roll system maintained at a temperature of between about 130° and about 190° C.; heat treating the drawn filaments by passing said filaments for 144–192 milliseconds over a heated roll system maintained at a temperature in the range of about 246° to about 249° C., said filaments being maintained at a tension in grams of between about 0.045 and about 0.075 gram per denier; and winding up said filaments.

* * * * *